US008278825B2

(12) United States Patent
Michel et al.

(10) Patent No.: US 8,278,825 B2
(45) Date of Patent: Oct. 2, 2012

(54) MOTOR VEHICLE LAMP

(75) Inventors: Andre Michel, Aachen (DE); Adam Lind, Baesweiler (DE); Klaus Schoeller, Nideggen (DE); Hans-Alo Dohmen, Aldenhoven (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 13/003,584

(22) PCT Filed: Jul. 8, 2009

(86) PCT No.: PCT/IB2009/052961

§ 371 (c)(1), (2), (4) Date: Jan. 11, 2011

(87) PCT Pub. No.: WO2010/007558

PCT Pub. Date: Jan. 21, 2010

(65) Prior Publication Data

US 2011/0101843 A1 May 5, 2011

(30) Foreign Application Priority Data

Jul. 15, 2008 (EP) ..... 08104738

(51) Int. Cl.
*H01J 17/16* (2012.01)

(52) U.S. Cl. ..... 313/635; 313/493; 313/112

(58) Field of Classification Search ..... 313/635, 313/634, 493, 112
See application file for complete search history.

(56) References Cited

U.S. PATENT DOCUMENTS

| | | | |
|---|---|---|---|
| 6,611,101 | B1 | 8/2003 | Mitobe et al. |
| 7,183,712 | B2 | 2/2007 | Schoeller et al. |
| 2006/0007696 | A1 | 1/2006 | Takagaki et al. |

FOREIGN PATENT DOCUMENTS

| | | | |
|---|---|---|---|
| EP | 1102306 | A1 | 5/2001 |
| WO | 2004053924 | A2 | 6/2004 |

*Primary Examiner* — Vip Patel
(74) *Attorney, Agent, or Firm* — Mark L. Beloborodov

(57) ABSTRACT

The invention relates to a lamp for motor vehicle headlamps, and in particular a high intensity discharge lamp, comprising at least one envelope which is arranged on a base and which is provided with two coatings arranged diametrically opposite one another, wherein the coatings (3) are identical in form and project at least 0.5 millimeters upwards beyond a horizontal plane in which, when the lamp is in the burnt-in position, the reference axis (R) which passes through the center of the base (4) lies.

7 Claims, 2 Drawing Sheets

MOTOR VEHICLE LAMP

The invention relates to a lamp for motor vehicle headlamps, and in particular a high intensity discharge lamp, comprising at least one envelope which is arranged on a base and which is provided with two coatings arranged diametrically opposite one another.

Incandescent lamps have long been used in the automotive field as a light source for motor vehicle headlamps but as well as these what are also increasingly being used are high intensity discharge lamps, due to the considerable improvement they show in light yield over incandescent lamps. In known discharge lamps, a gas discharge is produced between two electrodes in a closed discharge vessel and this gas discharge emits very bright light.

Headlamps for vehicles, having for example a low-beam function, are, for the purposes of the invention, all headlamps which produce a light/dark cut-off, such for example as pure low-beam headlamps and combined high-beam and low-beam headlamps.

Headlamps are usually fitted with lamps which emit visible light of almost the same color in all directions in space, which means that what is then regularly produced is a road space which is lit in a uniform color. A variety of specifications exist for motor vehicle headlamps and these lay down stringent requirements. In this way, low-beam light for example must have an asymmetrical light distribution with a sharply defined light/dark cut-off which is substantially horizontal, so that oncoming traffic will not be dazzled. For example, taking the co-ordinate system used on the European measuring screen, the measuring point which is crucial to the range of a headlamp is 75 R and the illuminance laid down for this point, when the headlamp is switched to low-beam light, is a minimum of 12 lux. The light/dark cut-off, beyond which lies what is referred to as segment III of the masking means in which the illuminance may not be more than just 0.7 lux, extends only half a degree away from said measuring point. The majority of headlamps comprise so-called projection optical systems which comprise an elliptical reflector which focuses the light emitted by the light source onto a masking means which creates the light/dark cut-off and a lens which produces the so-called light distribution in the road space. A good headlamp is distinguished by having a contrast which is as good as possible in the region of the light/dark cut-off.

When motor vehicle headlamps are being designed, an increasingly frequent desideratum is for the light emitted from the headlamp to be individualized. When this is done, the form of the emitted light must be within the standards laid down and in particular it must be ensured that the color temperature range is within the ECE white field.

Against this background, it is an object of the present invention to provide a lamp for motor vehicle headlamps which, while complying with the standards laid down, makes it possible for an individualized light beam to be emitted. In accordance with the invention, this object is achieved by making the coatings identical in form and by causing them to project at least 0.5 mm upwards beyond a horizontal plane in which, when the lamp is in the burnt-in position, the reference axis which passes through the center of the base lies.

By means of the invention, there is provided for motor vehicle headlamps a lamp which, while complying with the standards laid down, makes it possible for an individualized light beam to be emitted. The coatings of identical form which are arranged diametrically opposite one another make a "tinting" possible in the region of the light/dark cut-off whereby the desired individualization is achieved. The coatings are preferably rectangular in form.

In one embodiment of the invention, the coatings are of a width of at least 1.5 mm and a length of at least 2 mm. Significant coloration can be achieved by this means in the region of the light/dark cut-off.

In an embodiment of the invention, the coatings have at least two regions having different light transmissions. What is achieved in this way is coloration where the color is of different intensities. Advantageously, one region has a light transmission of at least 40%. One region preferably has a light transmission of less than 3%.

In one embodiment of the invention, the region having the highest light transmission is so arranged that, when used in a reflection system or in a projection system, the maximum illumination by the light which is transmitted by the coatings takes place in the region of the kink of the elbow of the light/dark cut-off. What can be achieved in this way is a striking design for the beam of light while at the same time complying with the standards laid down.

The coatings are preferably so designed that only blue light is transmitted. Blue light is notable for the fact that no dazzle effect is caused to oncoming traffic.

Other embodiments and refinements of the invention are specified in the other claims. An embodiment of the invention is shown in the drawings and will be described in detail below.

The high intensity discharge lamp which has been selected as an embodiment comprises an outer envelope 1 in which a burner 2 is arranged and which is connected to a base 4.

Figure 1:
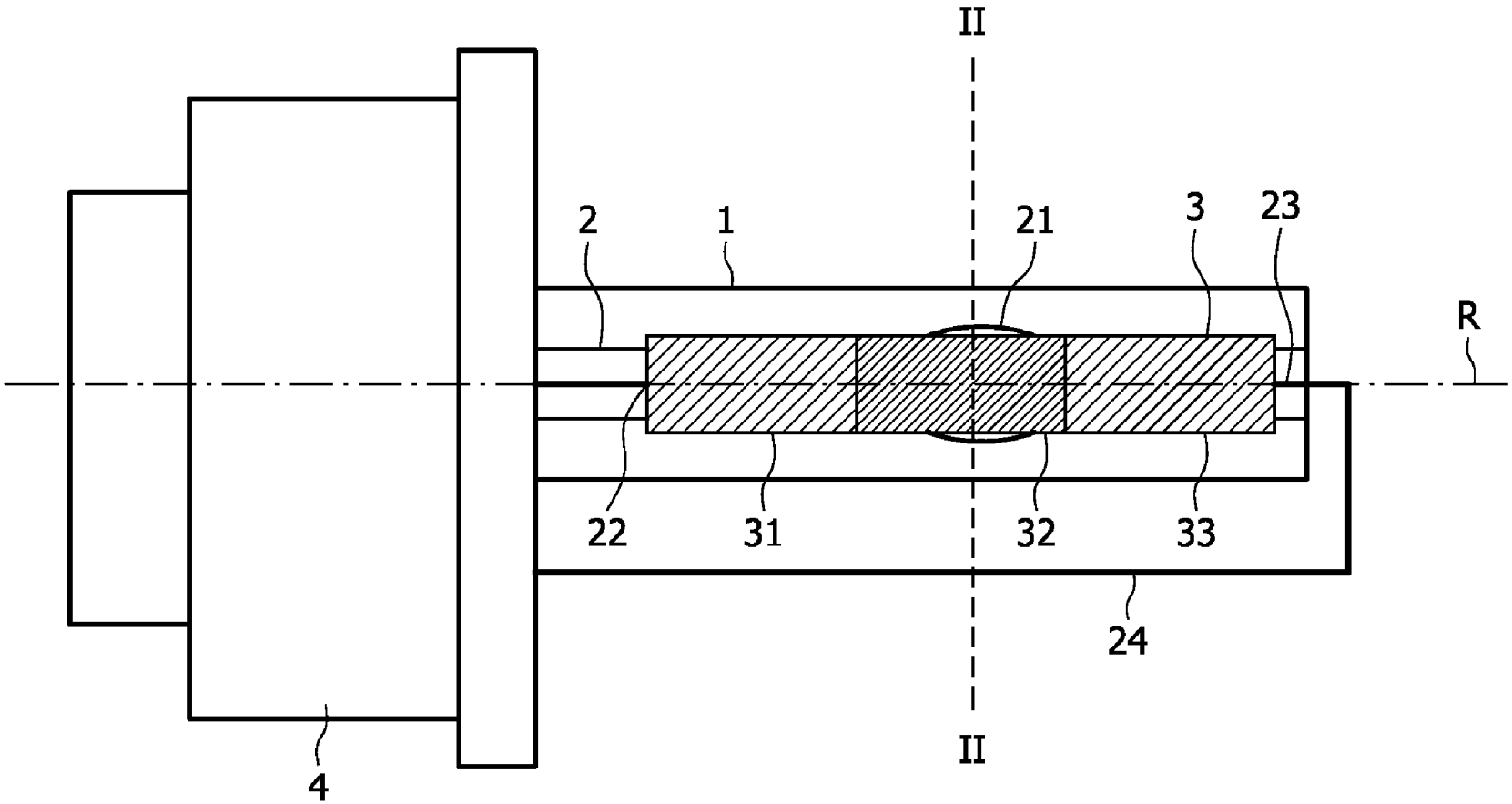
FIG. 1 is a schematic view of a high intensity discharge lamp from the side.
Figure 2:
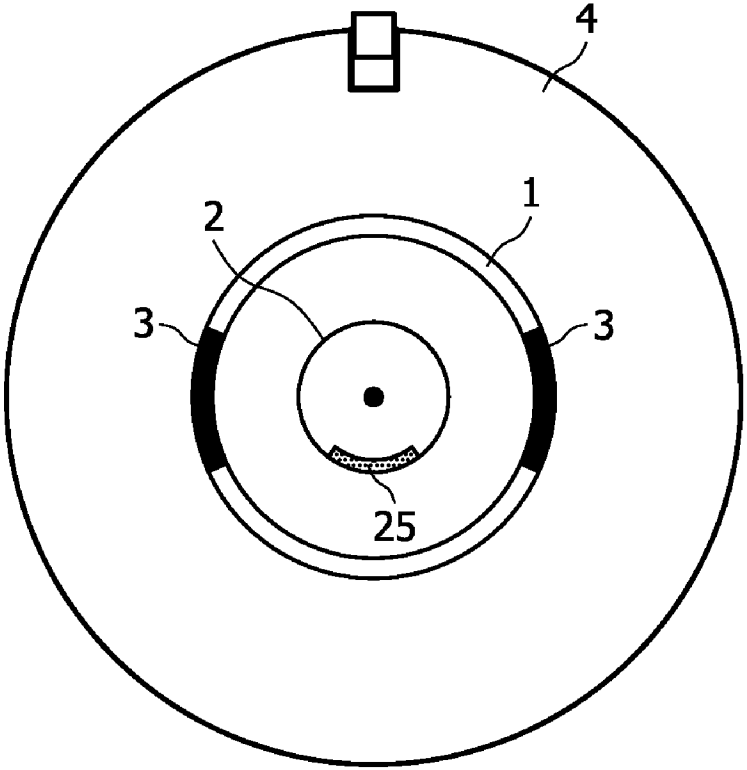
FIG. 2 is a cross-section on line II-II in FIG. 1.

The high intensity discharge lamp is shown in FIG. 1 in an approximately horizontal installed position. The reference axis R, which is shown as a dotted and dashed line, extends through the center of the base 4 in this case. The burner 2 encloses a discharge chamber 21 at the bottom of which is situated a "salt lake" or halide pool 25. The burner 2, which is sealed off with a vacuum-tight seal and which transmits light, is made of quartz glass. The discharge chamber 21 is filled with an ionizing gas mixture which comprises at least one inert gas, and in particular xenon, and a mixture of metal halides. Arranged in the usual manner in the discharge chamber 21 are two electrodes which are connected to the electrical conductors 22, 23. The electrical conductor 23 is connected in turn to the return pole 24, which latter runs to the base 4, outside the outer envelope 1, approximately parallel to the longitudinal axis of the lamp, The free distance between the two electrodes forms the discharge path, in the center of which the center of the discharge chamber 21 too is situated.

Arranged diametrically opposite one another on the surface of the outer face of the outer envelope 1 are two coatings 3 in strip form. In the embodiment, the coatings 3 each have three regions 31, 32, 33 having different light transmissions. In the embodiment, the light transmission of region 31 is 45%, that of region 32 is 25% and that of region 33 is 35%. The coating 3 is applied to the outer envelope 1 symmetrically to the reference axis R. The width of the coating 3 is selected to be somewhat smaller than the maximum diameter of the discharge chamber 21.

In the embodiment, the coating 3 takes the form of an interference filter, with blue light being transmitted and yellow light reflected. The length of the coating 3 should be selected in such a way that it measures at least two millimeters around the center of the light source, i.e. of the arc which forms between the electrodes. What can be achieved in this way is significant "tinting" in the region of the light/dark cut-off.

The invention claimed is:

1. A high intensity discharge lamp for motor vehicle headlamps, comprising at least one envelope which is arranged on a base and which is provided with two coatings arranged diametrically opposite one another, wherein the coatings are substantially identical in form and project at least 0.5 millimeters upwards beyond a horizontal plane in which, when the lamp is in the burnt-in position, the reference axis (R) which passes through the center of the base lies, wherein the coatings are so designed that only blue light is transmitted.

2. A lamp as claimed in claim 1, wherein the coatings are rectangular in form.

3. A lamp as claimed in claim 1, wherein the coatings are of a width of at least 1.5 millimeters and a length of at least 2 millimeters.

4. A lamp as claimed in claim 1, wherein the coatings have at least two regions having different light transmissions.

5. A lamp as claimed in claim 4, wherein one region has a light transmission of at least 40%.

6. A lamp as claimed in claim 4, wherein one region has a light transmission of less than 30%.

7. A lamp as claimed in claim 1, wherein the coatings are formed by interference filters which transmit blue light and reflect yellow light.

* * * * *